US006745601B2

(12) United States Patent
Pierelli

(10) Patent No.: US 6,745,601 B2
(45) Date of Patent: Jun. 8, 2004

(54) METHOD FOR PRODUCING A RETENTIVE ELASTIC KNITTED FABRIC AND KNITTED FABRIC

(75) Inventor: Maurizio Pierelli, Cuggiono (IT)

(73) Assignee: Industria Centenari E Zinelli SpA, Milan (IT)

( * ) Notice: Subject to any disclaimer, the term of this patent is extended or adjusted under 35 U.S.C. 154(b) by 0 days.

(21) Appl. No.: 10/210,255

(22) Filed: Jul. 31, 2002

(65) Prior Publication Data

US 2003/0051512 A1 Mar. 20, 2003

(30) Foreign Application Priority Data

Jul. 31, 2001 (IT) ..... MI2001A001663
Oct. 3, 2001 (IT) ..... MI2001A002047

(51) Int. Cl.[7] ..... D04B 21/00
(52) U.S. Cl. ..... 66/195; 442/312
(58) Field of Search ..... 66/190, 191, 192, 66/193, 194, 195; 442/312, 313

(56) References Cited

U.S. PATENT DOCUMENTS 4,638,648 A 1/1987 Gajjar ..... 66/193
4,649,722 A 3/1987 Gajjar ..... 66/195
4,688,403 A 8/1987 Gajjar ..... 66/195
4,802,346 A * 2/1989 Gajjar ..... 66/195
5,029,457 A * 7/1991 Gajjar ..... 66/195
5,596,888 A * 1/1997 McLarty et al. ..... 66/195
5,687,587 A * 11/1997 Michel ..... 66/196
5,899,095 A * 5/1999 Spillane ..... 66/207

FOREIGN PATENT DOCUMENTS

| | | |
|---|---|---|
| EP | 0032871 | 7/1981 |
| EP | 0677604 | 10/1995 |
| GB | 2149435 | 6/1985 |
| GB | 2359826 | 9/2001 |

* cited by examiner

*Primary Examiner*—Danny Worrell
(74) *Attorney, Agent, or Firm*—Sheridan Ross PC

(57) ABSTRACT

The invention provides a method for producing elastic knitted fabric on a Raschel or tricot machine. The method utilizes a four bar knitting structure and four thread feeders. The needle guides of the first and fourth bars are threaded with non-elastic yarn, while the needle guides of the second and third bars are threaded with elastic yarn. Each elastic thread is worked in plating with the respective non- elastic thread.

16 Claims, 14 Drawing Sheets a) 1st and 2nd rod b) 3rd and 4th rod c) fabric a) 1st rod b) 2nd rod c) 3rd rod d) 4th rod e) fabric a) 1st and 2nd rod b) 3rd and 4th rod c) fabric a) 1st and 2nd rod b) 3rd and 4th rod c) fabric a) 1st and 2nd rod b) 3rd and 4th rod c) fabric a) 1st and 2nd rod b) 3rd and 4th rod c) fabric a) 1st and 2nd rod b) 3rd and 4th rod c) fabric

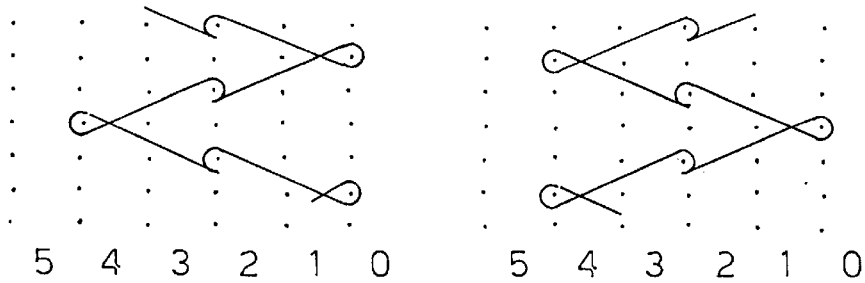
a) 1st and 2nd rod
b) 3rd and 4th rod
FIG. 9
c) fabric
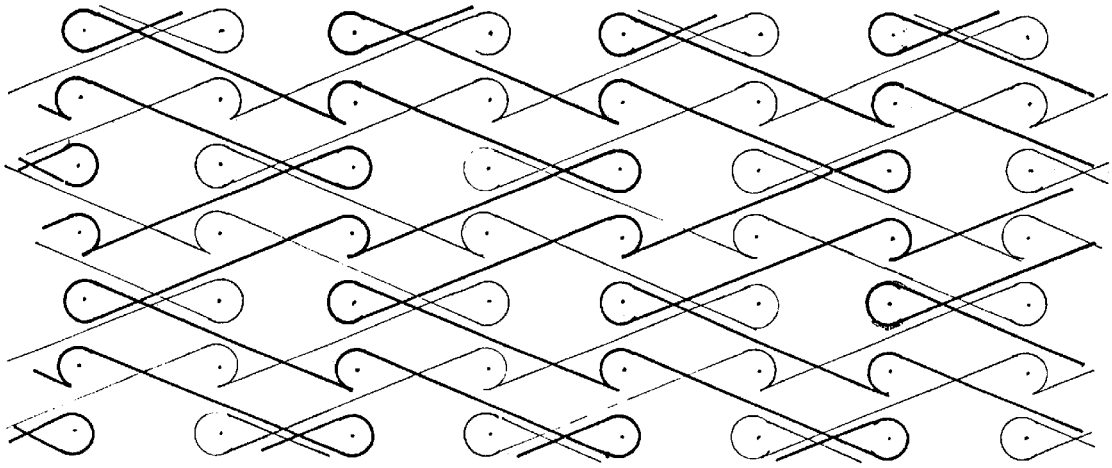

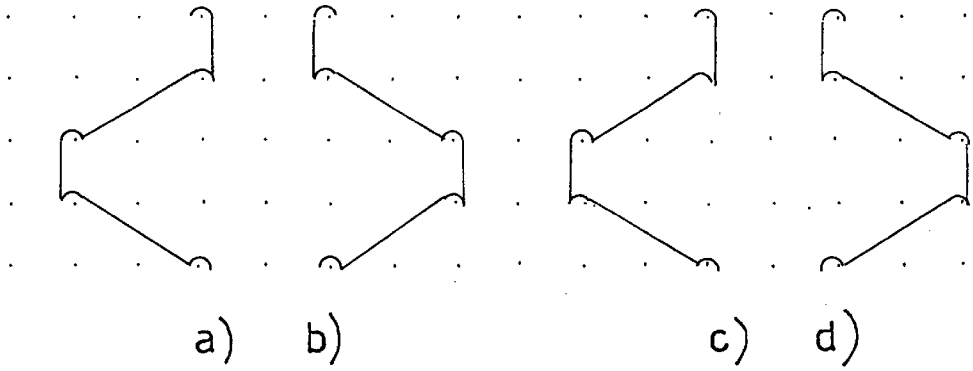
FIG. 10
e)
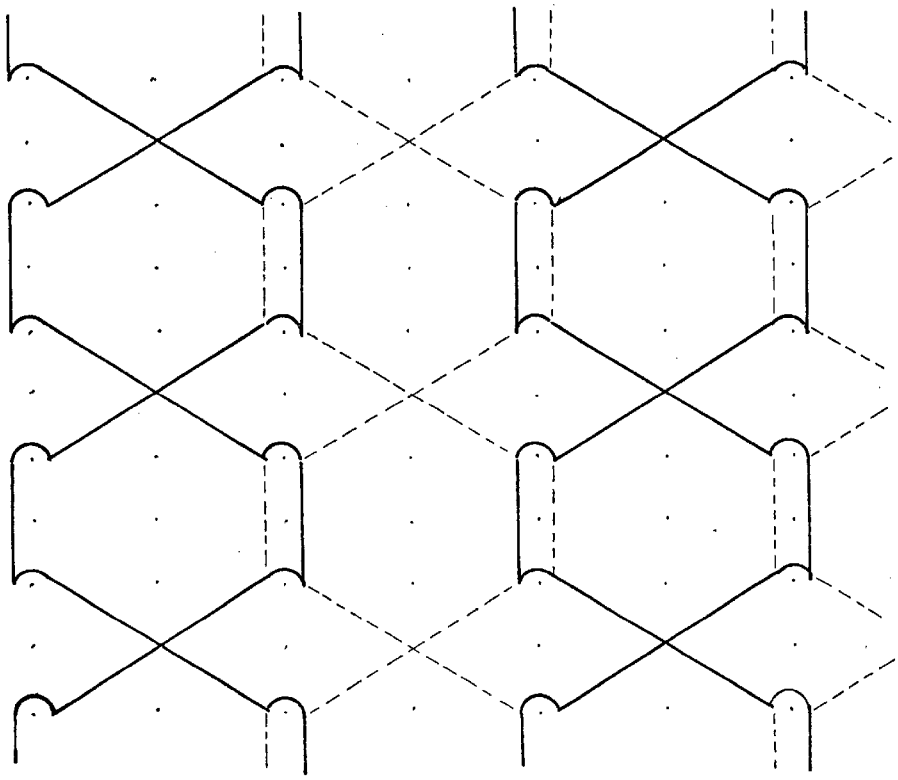

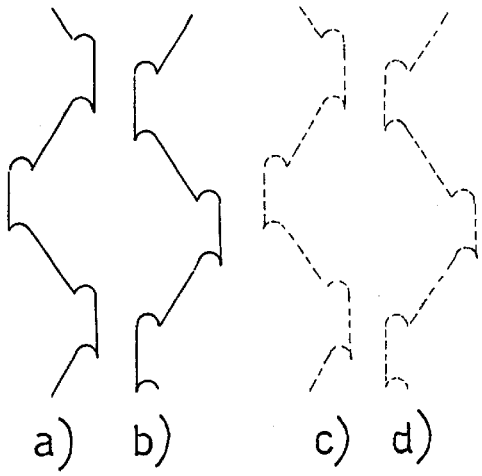
FIG. 11
e)
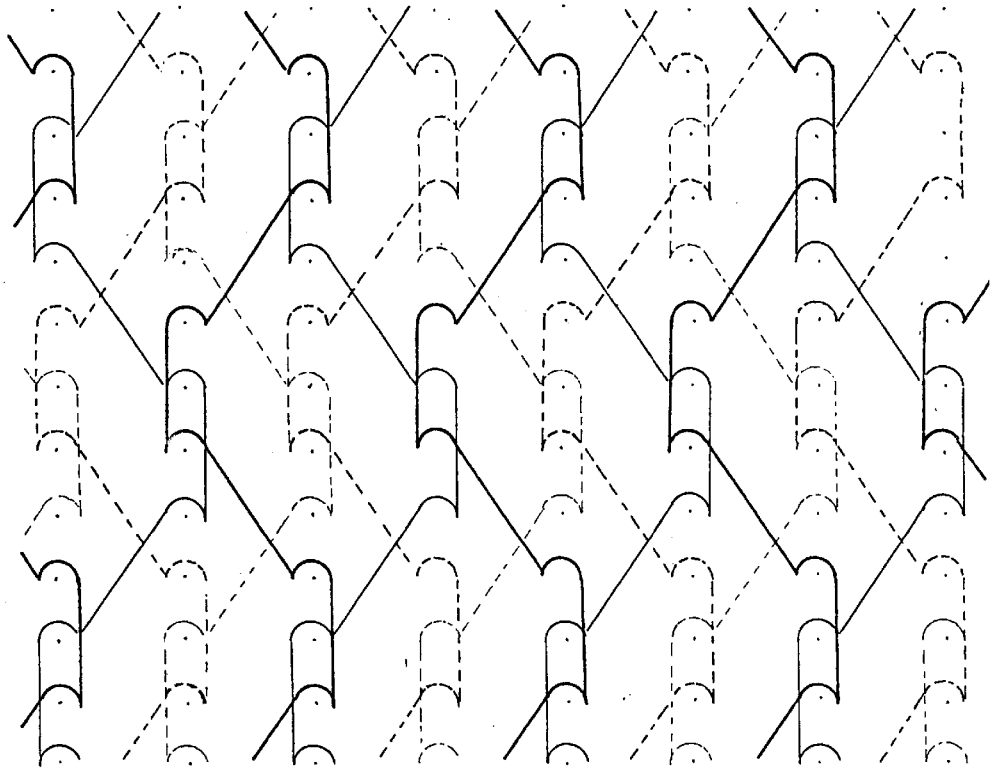

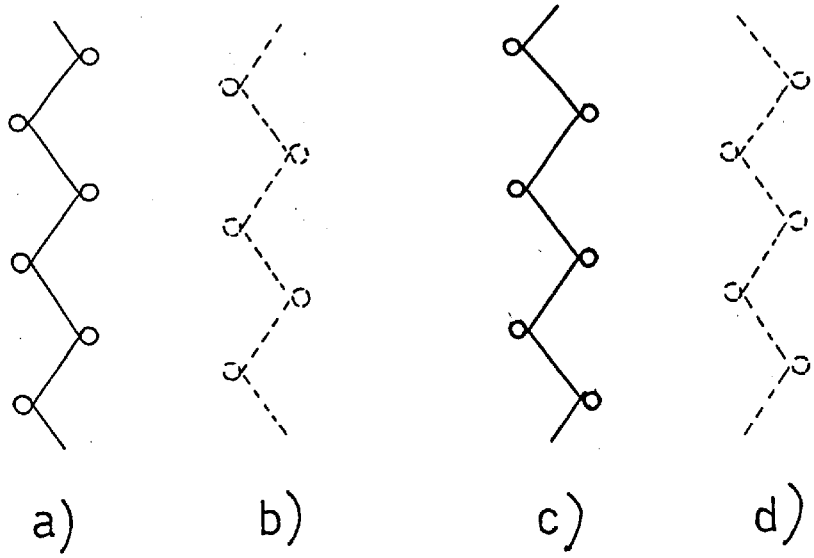
FIG. 12
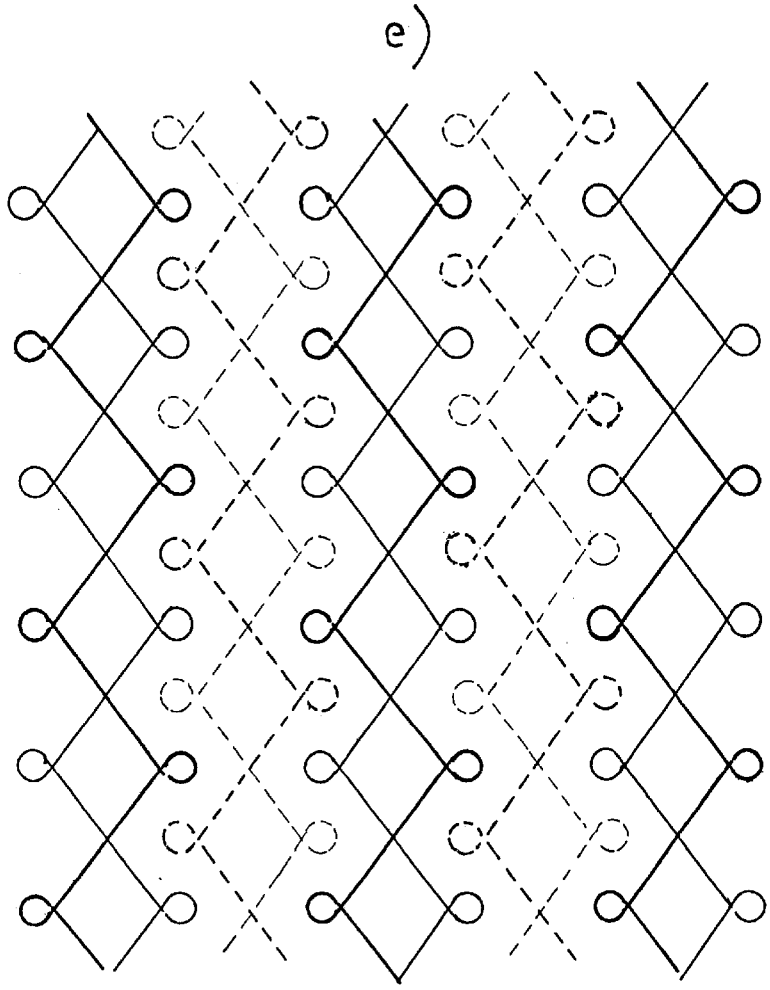

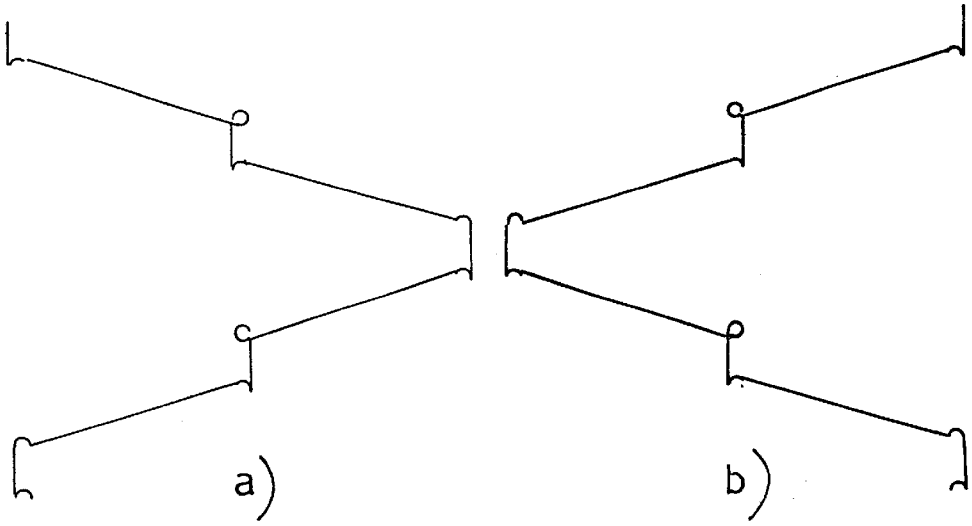
FIG. 14
c)
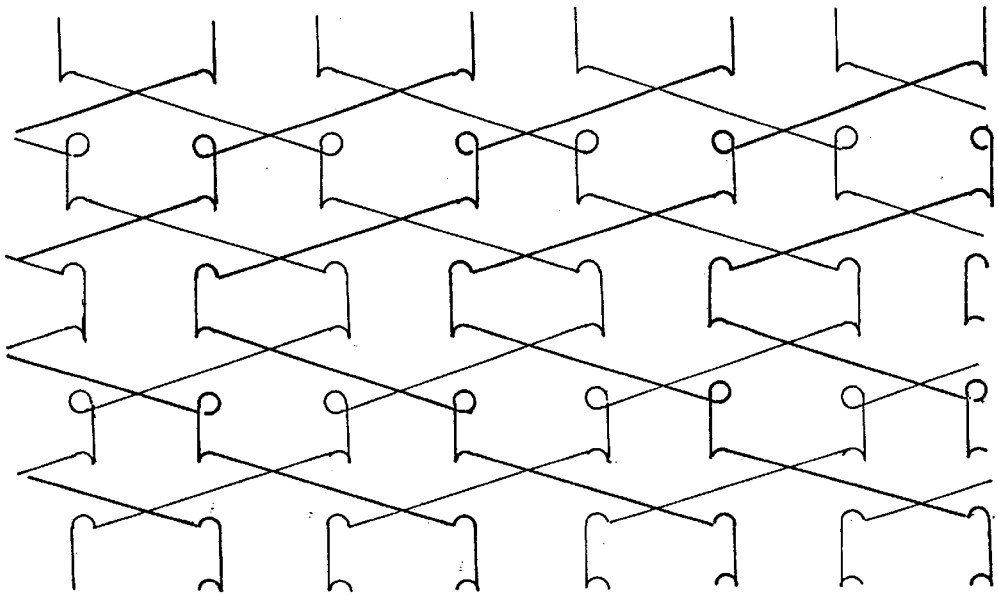

METHOD FOR PRODUCING A RETENTIVE ELASTIC KNITTED FABRIC AND KNITTED FABRIC

The invention relates to the field of elastic warp knitted fabrics.

The prior art includes fabrics with basic plating construction or knit pattern produced on tricot machines and Raschel machines with two knitting bars moving in one direction. One problem with such fabrics is that the construction is unbalanced because the yarns both move in the same direction.

The prior art also includes four-bar knitting machines which are used for the production of Jacquard knitted fabrics.

It is also possible to produce an elastic knitted fabric in which the base construction contains an elastic yarn and at least one non-elastic yarn, running in opposite directions.

The abovementioned prior art provides fabrics which have differing degrees of elasticity in the two directions. Generally, there is increased elasticity in one direction, which we shall call lengthwise, and little or none in the other direction, which we shall call crosswise or transverse. The direction in which patterns for items of clothing are laid out on the fabric for cutting is therefore fixed. Furthermore the retentive capacity of the fabric is different in the different directions.

One aim of this application is to obtain a fabric with improved elasticity and retentive capacity in a crosswise direction. A further aim is to provide a fabric with high breathability. Another aim is to provide fabrics with a new aesthetic appearance.

The said aims have been achieved with the invention as expressed in the independent claims.

Further new and useful characteristics are contained in the dependent claims.

In other words, according to this invention a warp knitted fabric is produced on a tricot machine or four-bar Raschel machine using four threads, two of which are elastic and two are non-elastic; each thread is knitted in parallel (in plating) with a non-elastic thread. In variants of the invention, a fifth and a sixth thread may be added to the basic structure as explained above, these being so-called "special effect" threads worked on a fifth and sixth bar.

Elastomer yarn with a thread count of between 15 dtex and 210 dtex is preferably used as the elastic component while nylon or other non-elastic yarns with a thread count of between 15 dtex and 156 dtex are used as the non-elastic component.

The non-elastic yarn shall be referred to hereafter also as "rigid thread" for simplicity of expression.

The invention achieves the aims set out above, producing knitted fabrics with a new aesthetic appearance and makes it possible to obtain excellent technical characteristics as regards the retentive and modelling capacity of the fabric. The retentive capacity of the fabric can be uniform in all directions, so that patterns no longer have to be laid out on the fabric in a set direction, thus permitting better use of the fabric.

Exemplary unrestricted embodiments of the invention will be described as follows with reference to the attached drawings, in which:

FIG. 9 shows a further construction pattern draft of a fabric and in particular a) shows the evolution of the first and second threads on the first and second needle guides, b) shows the development of the third and fourth threads on the third and fourth bars, and c) shows the basic knit of the fabric.

Figure 13:
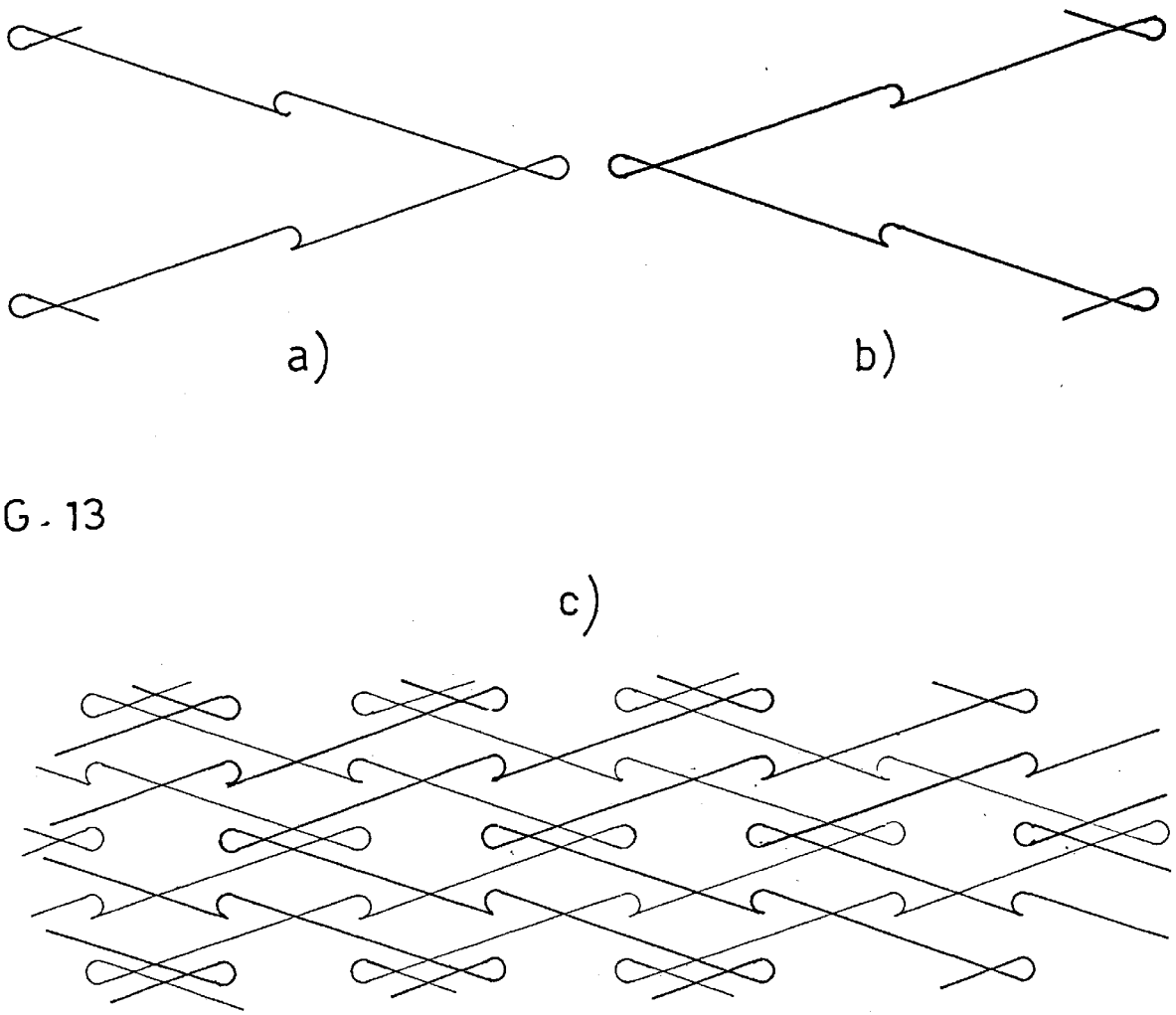

FIG. 10 is the construction pattern draft of a further type of fabric of the invention, with four base threads, i.e. two elastic and two non-elastic, knitted in double plating, with supplementary "special effect" threads, more specifically a) shows the evolution of the $1^{st}$ and $2^{nd}$ threads on the $1^{st}$ and $2^{nd}$ bars b) shows the evolution of the $3^{rd}$ and $4^{th}$ threads on the $3^{rd}$ and $4^{th}$ bars c) shows the evolution of the $5^{th}$ thread on the $5^{th}$ bar, d) shows the evolution of the $6^{th}$ thread on the $6^{th}$ bar, e) shows the construction fabric;

FIG. 11 is the construction pattern draft of a further type of fabric of the invention, with basic threads plus two "special effect" threads with the same annotations as FIG. 10 as regards a), b), c), d) and e);

FIG. 12 is the construction pattern draft of another type of fabric of the invention, in which a) shows the evolution of the first, second and fifth threads, b) shows the evolution of the third, the fourth and the sixth threads, c) shows the fabric;

FIG. 13 is the construction pattern draft of another type of fabric of the invention, in which a) shows the evolution of the first, second and fifth threads, b) shows the evolution of the third, fourth and sixth threads, c) shows the fabric;

FIG. 14 is the construction pattern draft of another type of fabric of the invention, with the same annotations as per a), b) and c) in FIG. 13.

In the figures, as is the custom, each point represents a needle of the needlebed or needlebar, a horizontal series of points constitutes a course of stitches or a pick, each vertical series of points constitutes a stitch wale. The spaces between the needles are numbered underneath.

Figure 1:
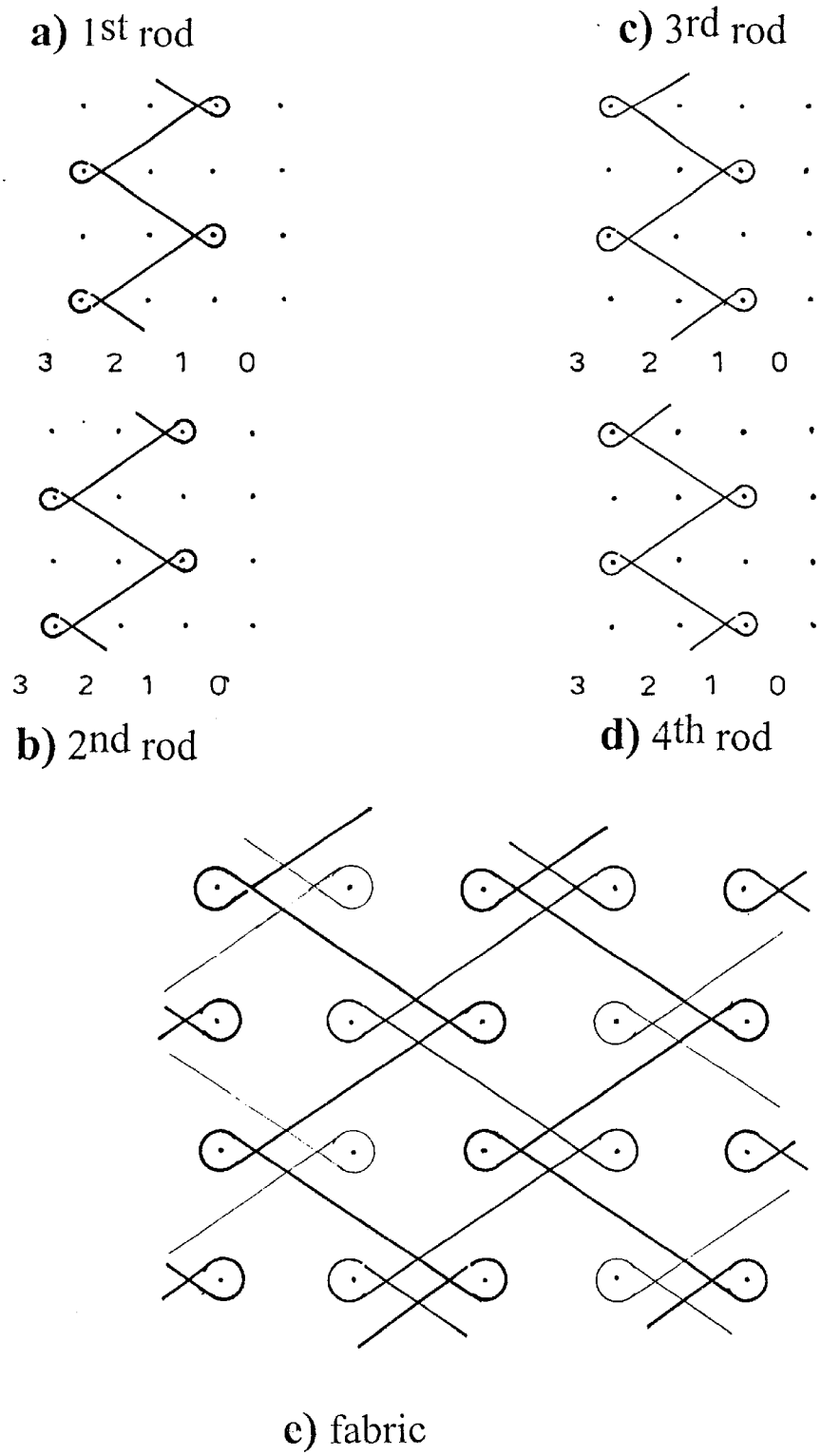
FIG. 1 is the construction pattern draft of a first type of fabric produced with the method of the invention, in particular a), b), c) and d) illustrate the evolutions of the $1^{st}$, $2^{nd}$, $3^{rd}$ and $4^{th}$ threads on the $1^{st}$, $2^{nd}$, $3^{rd}$ and $4^{th}$ bars; e) shows a basic length of the fabric.

The fabric represented in FIG. 1 is produced on a Raschel or tricot machine (preferably on a tricot machine for yams with a thread count equal or less than 160 dtex, on a Raschel knitting machine for yarns with a thread count equal or less than 78 dtex); the tricot machine has 4 bars with the needle guides alternately one threaded, one empty, the first and fourth bars have the needle guides threaded with non-elastic yarn, the second and third bars have the needle guides threaded with elastic yarn.

The pattern is as follows:

| | |
|---|---|
| 1st bar | 2-3/1-0 |
| 2nd bar | 2-3/1-0 |
| 3rd bar | 1-0/2-3 |
| 4th bar | 1-0/2-3 |

As can be seen, on the first bar there is a double tricot loop knit, on the second bar a double tricot loop knit, the threads on the first bar and on the second bar are worked in plating. On the third bar there is a double tricot loop knit, on the fourth a double tricot loop knit, the corresponding third and fourth threads are worked in plating and run in the opposite direction to the first two threads.

The fabric according to the first example may use 44 dtex nylon thread as the non-elastic yarn, and a 44 dtex elastomer as the elastic yarn. Tension should preferably be 3 g per thread.

As finishing, the fabric may be treated in solvent or water, heat fixed on a tenter at 185° C. for 40 minutes, dyed in rope form or beam dyed, dried and finished in a tenter.

Figure 2:
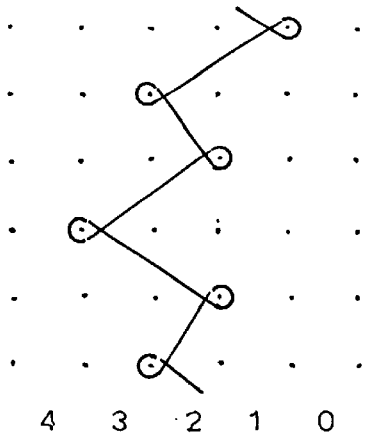
FIG. 2 is the construction pattern draft of a second type of fabric according to the invention; a) shows the evolutions of the $1^{st}$ and $2^{nd}$ threads on the $1^{st}$ and $2^{nd}$ bars; b) the evolutions of the $3^{rd}$ and $4^{th}$ threads on the $3^{rd}$ and $4^{th}$ bars; c) shows the fabric.
Figure 2:
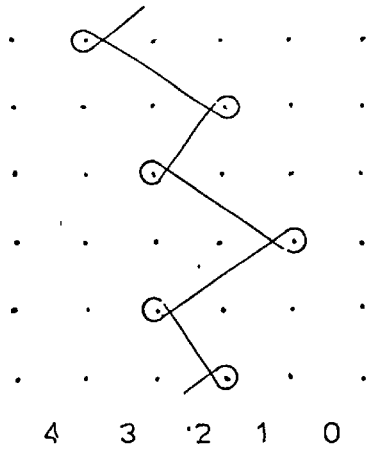
Figure 2:
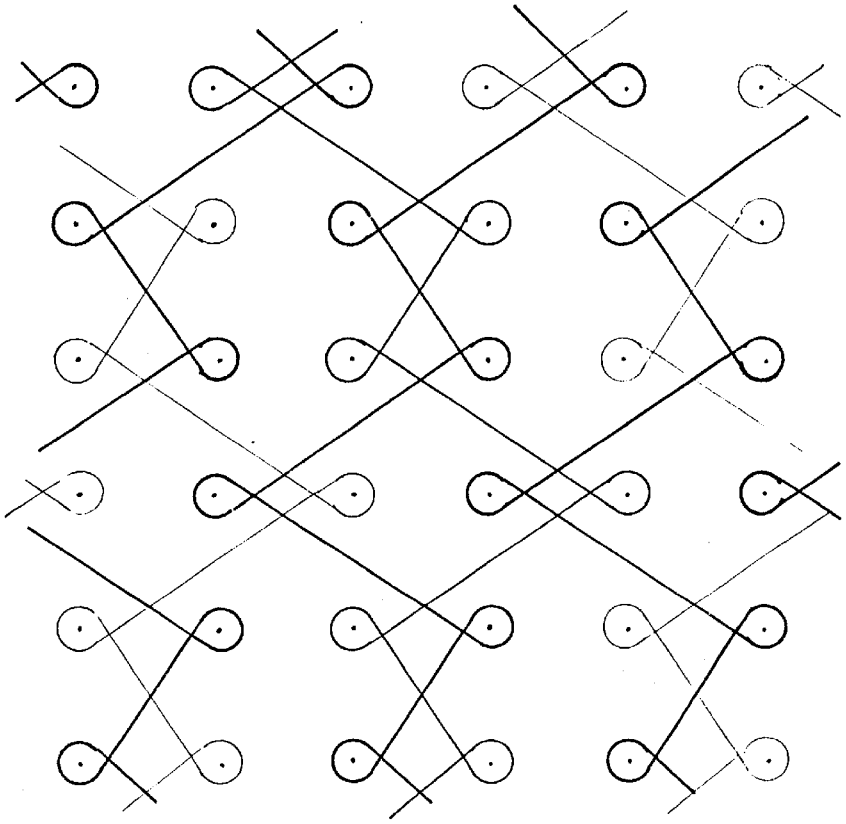

The fabric shown in FIG. 2 is produced on a Raschel or tricot machine with 4 bars with the needle guides alternating one threaded with one empty. The first and the fourth bars have the needle guides threaded with non-elastic yarn, the second and third bars have the needle guides threaded with elastic yarn.

The pattern is as follows:

| | |
|---|---|
| 1st bar | 2-3/2-1/3-4/2-1/2-3/1-0 |
| 2nd bar | 2-3/2-1/3-4/2-1/2-3/1-0 |
| 3rd bar | 2-1/2-3/1-0/2-3/2-1/3-4 |
| 4th bar | 2-1/2-3/1-0/2-3/2-1/3-4 |

As can be seen, on the first bar there is a double tricot loop knit for two picks, and simple for one pick, on the second bar the same pattern, the threads on the first and second bars are worked in plating. On the third bar there is a double tricot and simple loop knit in the opposite direction to the first bar, while there is the same pattern on the fourth bar as on the third bar, the corresponding third and fourth threads are worked in plating and run in the opposite direction to the first two threads.

Figure 3:
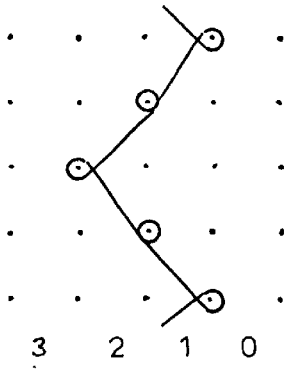
FIG. 3 is the construction pattern draft of a third type of fabric according to the invention, with the annotations at a), b), c), d) and e) as in FIG. 1.
Figure 3:
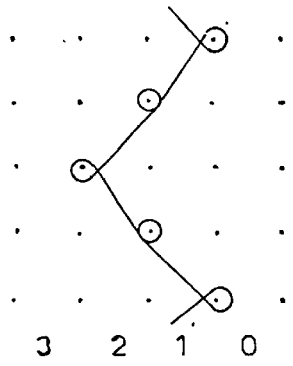
Figure 3:
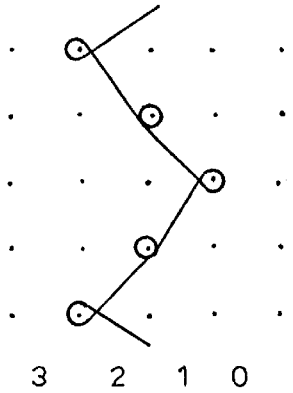
Figure 3:
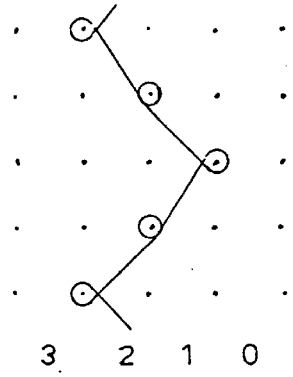
Figure 3:
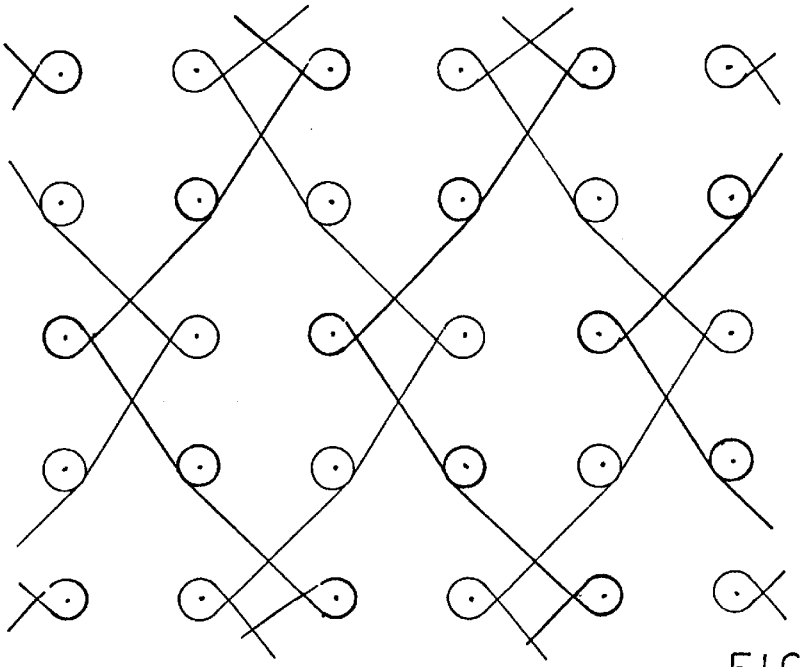

The fabric shown in FIG. 3 is produced on a Raschel machine or 4-bar tricot machine with the needle guides threaded with non-elastic yarn, the second and third bars have the needle guides threaded with elastic yarn.

The pattern is as follows:

| | |
|---|---|
| 1st bar | 1-0/2-1/2-3/1-2 |
| 2nd bar | 1-0/2-1/2-3/1-2 |
| 3rd bar | 2-3/1-2/1-0/2-1 |
| 4th bar | 2-3/1-2/1-0/2-1 |

As can be seen, on the first bar there is a simple herringbone pattern with closed stitches, on the second bar the same pattern, the threads on the first and second bars are worked in plating. On the third bar there is a simple herringbone pattern with closed stitches running in the opposite direction to the pattern of the first and second bars, while on the fourth there is the same pattern as on the third, the corresponding third and fourth threads are worked in plating and run in the opposite direction to the first two threads.

The pattern shown in FIG. 3 can also be produced with the intermediate point of the herringbone stitch open and in that case the pattern becomes:

| | |
|---|---|
| 1st bar and 2nd bar | 1-0/1-2/2-3/2-1 |
| 3rd bar and 4th bar | 2-3/2-1/1-0/1-2 |

Figure 4:
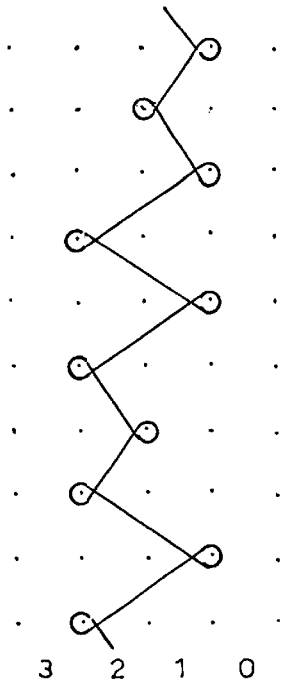
FIG. 4 is the construction pattern draft of a fourth type of fabric according to the invention, with the annotations at a), b) and c) as in FIG. 2.
Figure 4:
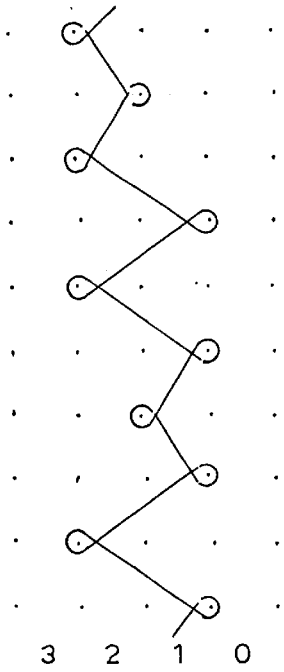
Figure 4:
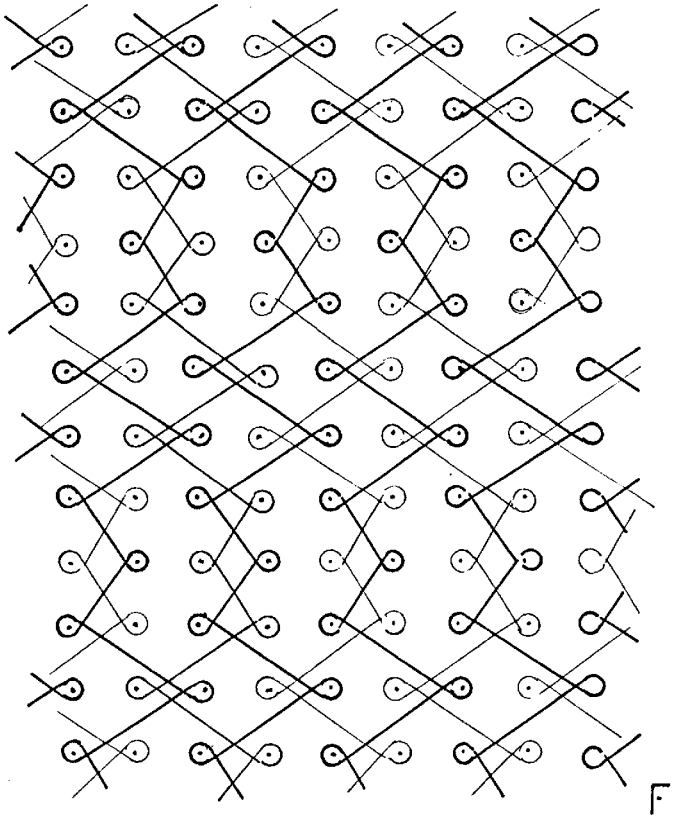

The fabric shown in FIG. 4 is produced on a Raschel or warp knitting machine with 4 bars with the needle guides alternating one threaded with one empty. The first and fourth bars have needle guides threaded with non-elastic yarn, the second and third bars have the needle guides threaded with elastic yarn.

The pattern is as follows:

| | |
|---|---|
| 1st bar | 2-3/1-0/2-3/2-1/2-3/1-0/2-3/1-0/1-2/1-0 |
| 2nd bar | 2-3/1-0/2-3/2-1/2-3/1-0/2-3/1-0/1-2/1-0 |
| 3rd bar | 1-0/2-3/1-0/1-2/1-0/2-3/1-0/2-3/2-1/2-3 |
| 4th bar | 1-0/2-3/1-0/1-2/1-0/2-3/1-0/2-3/2-1/2-3 |

As can be seen, on the first bar there is a simple and double tricot loop knit, on the second bar the same pattern, the threads on the first and seconds bar are worked in plating. On the third bar there is a loop knit running in the opposite direction to that of the first and second bars, on the fourth the same pattern as on the third, the corresponding third and fourth threads are worked in plating and run in the opposite direction to the first two threads.

FIG. 4*c*) shows a fabric in which the spacing between the picks is equal to half that between the needles.

It should be noted that other fabric patterns within the scope of the invention may be produced using the drawings described above. For example, by repeating the $3^{rd}$, $4^{th}$, $8^{th}$ and $9^{th}$ picks in the fabric shown in FIG. 4, it is possible to produce fabrics with different hole sizes. By eliminating the $1^{st}$, $6^{th}$, $7^{th}$, $8^{th}$, $9^{th}$ and $10^{th}$ picks, all the holes are made on the same horizontal or vertical axis. One such fabric is illustrated in FIG. 5 and has therefore the following pattern:

$1^{st}$ and $2^{nd}$ bars 1-0/2-3/2-1/2-3
$3^{rd}$ and $4^{th}$ bars 2-3/1-0/1-2/1-0

Figure 5:
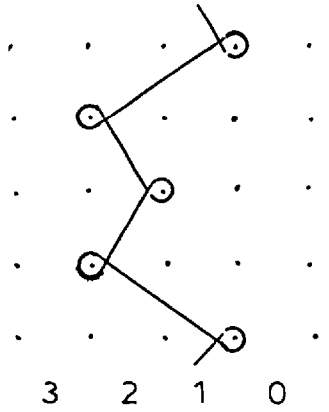
FIG. 5 shows a variant of the fabric as shown in FIG. 4.
Figure 5:
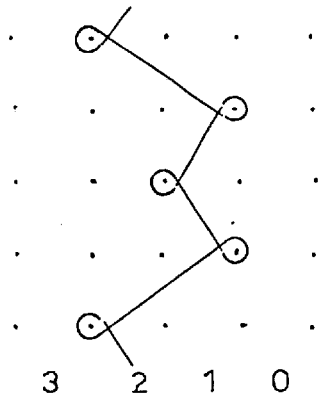
Figure 5:
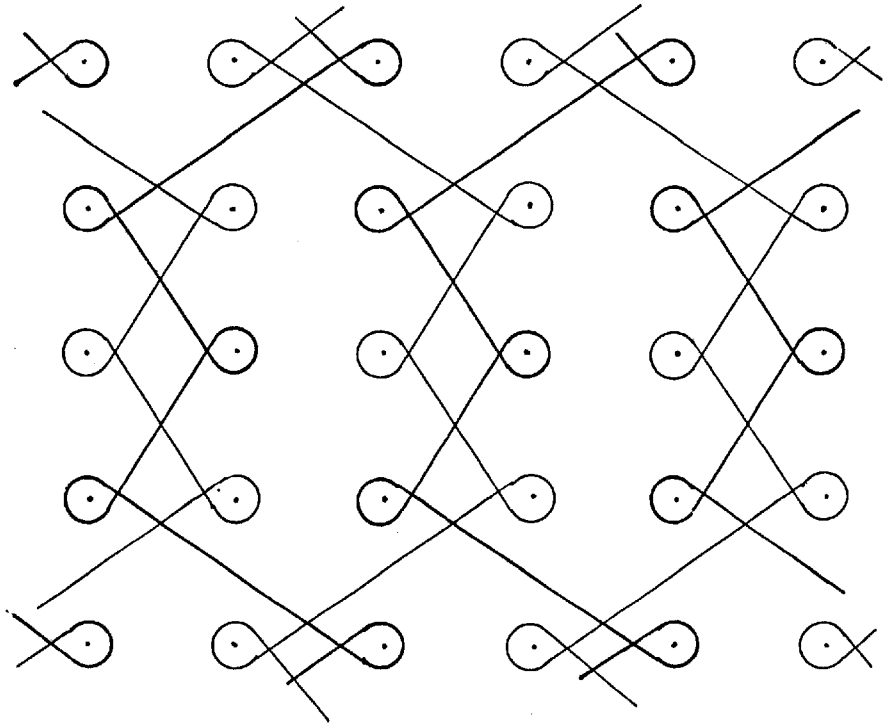

The fabrics in FIGS. 4 and 5 have rectangular holes and a crosswise elasticity that differs from the lengthwise elasticity.

Figure 6:
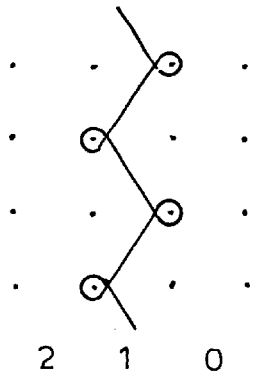
FIG. 6 shows another fabric; a) shows the evolution of the threads on the $1^{st}$ and $2^{nd}$ bars; b) shows the evolution of the threads on the $3^{rd}$ and $4^{th}$ bars; e) shows the fabric.
Figure 6:
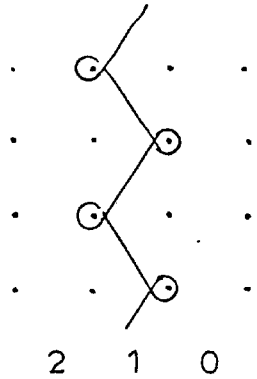
Figure 6:
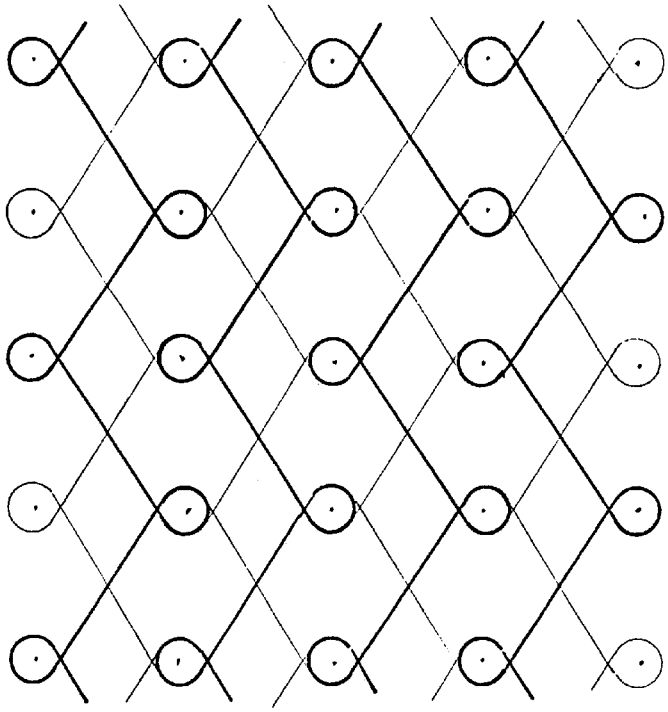

The fabric shown in FIG. 6 is made on a Raschel or four-bar warp knitting machine with all the needle guides threaded. The needle guides for the first and fourth bars are threaded with non-elastic yarn, while the needle guides for the second and third bars are threaded with elastic yarn. The pattern is as follows:

$1^{st}$ bar 1-2/1-0
$2^{nd}$ bar 1-2/1-0
$3^{rd}$ bar 1-0/1-2
$4^{th}$ bar 1-0/1-2

Figure 7:
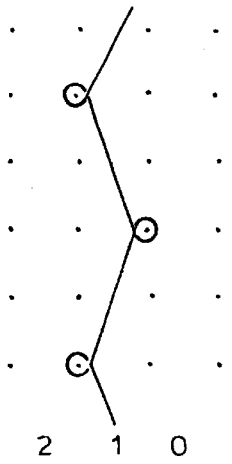
FIG. 7, shows a further fabric according to the invention and in particular a) shows the evolution of the threads on the $1^{st}$ and $2^{nd}$ bars, b) the evolution of the threads on the $3^{rd}$ and $4^{th}$ bars, c) the fabric.
Figure 7:
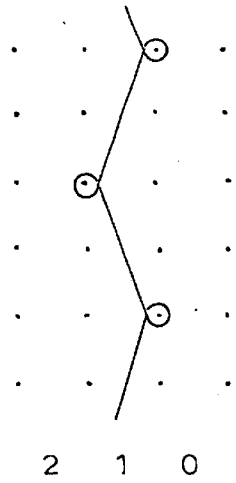
Figure 7:
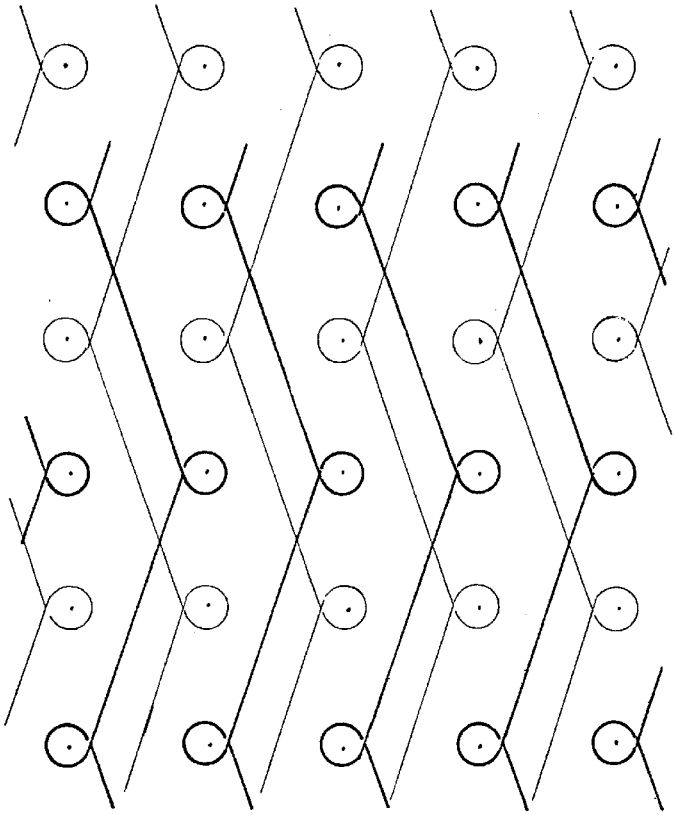

The result is a "balanced" fabric, that is with almost uniform elasticity in lengthwise and crosswise directions, but with a closer knit providing less breathability than the fabrics previously described. The fabric in FIG. 7 is also made with all the needle guides threaded, with non-elastic yarn on the $1^{st}$ and $4^{th}$ bars, elastic yarn on the $2^{nd}$ and $3^{rd}$ bars, and the following pattern:

$1^{st}$ and $2^{nd}$ bar . . . 1-2/1-1/1-0/1-1
$3^{rd}$ and $4^{th}$ bar . . . 2-2/1-0/1-1/2-3 and with the pattern running in one direction. An extremely pleasing fabric is produced.

Figure 8:
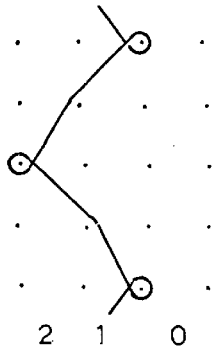
FIG. 8, shows a further fabric, with the same meanings for a), b) and c) as in the preceding figure.
Figure 8:
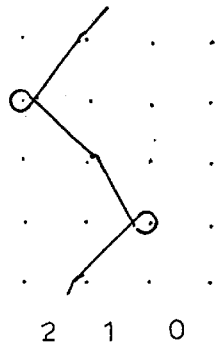
Figure 8:
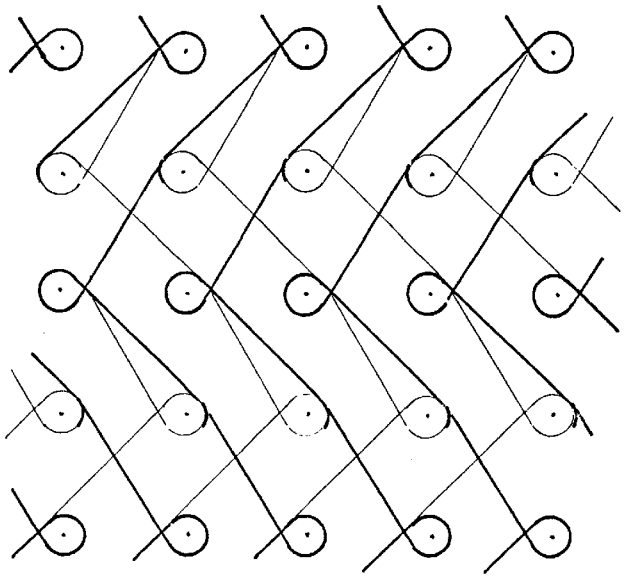

The fabric in FIG. 8 is also produced with all the needle guides threaded, with non-elastic yarn on the $1^{st}$ and $4^{th}$ bars, with elastic yarn on the $2^{nd}$ and $3^{rd}$ bars and the following pattern:

$1^{st}$ and $2^{nd}$ bar 1-0/1-1/2-3/2-2
$3^{rd}$ and $4^{th}$ bar 2-2/1-0/1-1/2-3 and with the pattern running in one direction. An extremely pleasing fabric is produced.

The fabric in FIG. 9 is described below.

The fabric is produced on a Raschel or warp knitting machine (preferably on warp knitting machine for yarns with a thread count equal to or less than 160 dtex, on a Raschel machine for yarns with a thread count equal to or greater than 160 dtex). The machine has four bars with the needle guides alternating one threaded with one empty, the first and fourth bars have the needle guides threaded with non-elastic yarn, the second and the third bars have the needle guides threaded with elastic yarn. Polyurethane such as Lycra is recommended as the elastic yarn, while polyamide (nylon) is recommended as the non-elastic yarn.

The pattern is as follows:

$1^{st}$ and $2^{nd}$ bar 1-0/2-3/4-5/3-2
$3^{rd}$ and $4^{th}$ bar 4-5/3-2/1-0/2-3

The fabric can also be produced with closed stitches to make it firmer with the following pattern:

$1^{st}$ and $2^{nd}$ bar 1-0/3-2/4-5/2-3
$3^{rd}$ and $4^{th}$ bar 4-5/2-3/1-0/3-2

As can be seen, on the first and second bar there is a herringbone pattern with alternatively open and closed stitches, with two needles moving on all the picks. On the third and fourth bar there is an identical herringbone pattern running in the other direction.

The resulting fabric is very firm and balanced retentive strength and elasticity.

The following is a description of the form of embodiment illustrated in FIG. 10. The fabric is produced on four base or bottom bars and two bars for the "special effect" thread. The first bar works the rigid (that is to say non-elastic) ground thread, the second bar works the ground elastic thread in plating with the first; the third bar works the ground elastic thread in plating with the fourth; the fourth bar works the ground rigid thread; the fifth bar works the rigid "special effect" thread, the sixth bar works the rigid "special effect" thread. Threading on the first, the second and the sixth bars is one threaded alternated with one empty; on the third, the fourth and the fifth bars one empty alternated with one threaded. The pattern is as follows:

$1^{st}$, $2^{nd}$ $5^{th}$ bar 0-1/1-2/2-1/1-0
$3^{rd}$, $4^{th}$, $6^{th}$ bar 2-1/1-0/0-1/1-2

The fabric obtained has a "piquet" appearance.

The following is a description of the form of embodiment illustrated in FIG. 11. The fabric is produced with four bars carrying the base or ground thread and two bars threaded with the "special effect" thread; the first bar works the rigid ground thread, the second bar works the elastic ground thread in plating with the first; the third bar works the elastic ground thread in plating with the fourth; the fourth bar works the rigid ground thread; the fifth bar works the rigid "special effect" thread, the sixth bar works the rigid "special effect" thread. Threading on the first, second, third and fourth bars is one threaded alternated with one empty; on the first and sixth bars one empty alternated with one threaded. The pattern is as follows:

$1^{st}$, $2^{nd}$, $5^{th}$ bar 0-1/1-1/1-2/2-2/2-1/1-1/1-0/0-0
$3^{rd}$, $4^{th}$, $6^{th}$ bar 1-1/1-0/0-0/0-1/1-1/1-2/2-2/2-1

The fabric obtained has a crêpe appearance.

The following is a description of the form of embodiment illustrated in FIG. 12. The fabric is produced on four base bars for ground threads and two bars for the "special effect" thread: the first bar works the rigid ground thread, the second bar works the elastic ground thread in plating with the first; the third bar works the elastic ground thread in plating with the fourth; the fourth bar works the rigid ground thread; the fifth bar works rigid "special effect" thread, the sixth bar works the rigid "special effect" thread. Threading on the first, second and fifth bars is one threaded alternated with one empty; on the third, fourth and sixth bars one empty alternated with one threaded.

The pattern is as follows:

$1^{st}$ $2^{nd}$ bars 1-2/1-1/1-0/1-1
$3^{rd}$, $4^{th}$ bars 1-1/1-2/1-1/1-0
$5^{th}$ bar 1-0/1-1/1-2/1-1
$6^{th}$ bar 1-1/1-0/1-1/1-2

The fabric obtained has a "grosgrain" appearance.

The following is a description of the form of embodiment illustrated in FIG. 13. The fabric is produced on four base bars carrying the ground thread and two bars for the "special effect" thread; the first bar works the rigid ground thread, the second bar works the elastic ground thread in plating with the first; the third bar works the elastic ground thread in plating with the fourth; the sixth bar works rigid "special effect" thread. Threading on the first, second, third and fourth bars is one threaded and three empty, on the fifth and sixth bars two empty, one threaded and one empty. The pattern is as follows:

$1^{st}$, $2^{nd}$ $5^{th}$ bars 4-5/3-2/1-0/2-3
$3^{rd}$, $4^{th}$, $6^{th}$ bars 1-0/2-3/4-5/3-2

The pattern is double knitted atlas.

The following is a description of the form of embodiment illustrated in FIG. 14. The fabric is produced on four base bars carrying with the ground thread and two bars for the "special effect" thread; the first bar works the rigid ground thread, the second bar works the elastic ground thread in plating with the first; the third bar works the elastic ground thread in plating with the fourth; the fourth bar works the rigid ground thread; the fifth bar works the rigid "special effect" thread, the sixth bar works the rigid "special effect" thread. Threading on the first, second, third and fourth bars is one threaded and three empty, on the fifth and sixth bars two empty, one threaded and one empty. The pattern is as follows:

$1^{st}$, $2^{nd}$, $5^{th}$ bar 4-5/5-4/3-2/2-3/1-0/0-1/2-3/3-2
$3^{rd}$, $4^{th}$, $6^{th}$ bar 1-0/0-1/2-3/3-2/4-5/5-4/3-2/2-3

The pattern is double knitted atlas with chain stroke.

Any modifications to the embodiments described that may be made by a technician skilled in this field in any case fall within the scope of this invention and therefore are included in the attached claims.

What is claimed is:

1. Method for producing elastic knitted fabric on a Raschel or tricot machine, characterised by the fact that it uses a knitting machine with basic four bar knitting structure and four thread feeders; the needle guides of the first and fourth bars are threaded with non-elastic yarn, while the needle guides of the second and third bars are threaded with elastic yarn; each elastic thread is worked in plating with the respective non-elastic thread.

2. Method according to claim 1 in which one of the following patterns is used with the needle guides alternating one threaded with one empty:

A) $1^{st}$ bar 2-3/1-0
$2^{nd}$ bar 2-3/1-0
$3^{rd}$ bar 1-0/2-3
$4^{th}$ bar 1-0/2-3

B) $1^{st}$ bar 2-3/2-1/3-4/2-1/2-3/1-0
$2^{nd}$ bar 2-3/2-1/3-4/2-1/2-3/1-0
$3^{rd}$ bar 2-1/2-3/1-0/2-3/2-1/3-4
$4^{th}$ bar 2-1/2-3/1-0/2-3/2-1/3-4

C) $1^{st}$ bar 1-0/2-1/2-3/1-2
$2^{nd}$ bar 1-0/2-1/2-3/1-2
$3^{rd}$ bar 2-3/1-2/1-0/2-1
$4^{th}$ bar 2-3/1-2/1-0/2-1

D) $1^{st}$ bar and $2^{nd}$ bar 1-0/1-2/2-3/2-1
$3^{rd}$ bar and $4^{th}$ bar 2-3/2-1/1-0/1-2

E) $1^{st}$ bar 2-3/1-0/2-3/2-1/2-3/1-0/2-3/1-0/1-2/1-0
$2^{nd}$ bar 2-3/1-0/2-3/2-1/2-3/1-0/2-3/1-0/1-2/1-0
$3^{rd}$ bar 1-0/2-3/1-0/1-2/1-0/2-3/1-0/2-3/2-1/2-3
$4^{th}$ bar 1-0/2-3/1-0/1-2/1-0/2-3/1-0/2-3/2-1/2-3

F) $1^{st}$ bar 1-0/2-3/2-1/2-3
$2^{nd}$ bar 1-0/2-3/2-1/2-3
$3^{rd}$ bar 2-3/1-0/1-2/1-0
$4^{th}$ bar 2-3/1-0/1-2/1-0

G) $1^{st}$ bar 1-0/2-3/4-5/3-2
$2^{nd}$ bar 1-0/2-3/4-5/3-2
$3^{rd}$ bar 4-5/3-2/1-0/2-3
$4^{th}$ bar 4-5/3-2/1-0/2-3

G') $1^{st}$ bar 1-0/3-2/4-5/2-3
$2^{nd}$ bar 1-0/3-2/4-5/2-3
$3^{rd}$ bar 4-5/2-3/1-0/3-2
$4^{th}$ bar 4-5/2-3/1-0/3-2.

3. Method according to claim 1 characterised by the fact that a herringbone pattern is used for each thread with two needles moving on all the picks, with a herringbone pattern on the first and second bars in opposition to the herringbone pattern on the third and fourth bars.

4. Method according to claim 1 in which all the needle guides are threaded and one of the following patterns is used:

H) $1^{st}$ bar 1-2/1-0
$2^{nd}$ bar 1-2/1-0
$3^{rd}$ bar 1-0/1-2
$4^{th}$ bar 1-0/1-2

I) $1^{st}$ and $2^{nd}$ bars . . . 1-2/1-1/1-0/1-1
$3^{rd}$ and $4^{th}$ bars . . . 1-1/1-0/1-1/1-2

J) $1^{st}$ and $2^{nd}$ bars 1-0/1-1/2-3/2-2
$3^{rd}$ and $4^{th}$ bars 2-2/1-0/1-1/2-3.

5. Method according to claim 1 in which the non-elastic thread is nylon or a similar yarn, with a thread count from 15 dtex to 156 dtex, and the elastic yarn is an elastomer with a thread count from 15 dtex to 210 dtex.

6. Method according to claim 1 characterised by the fact that fifth and sixth bars are threaded with "special effect" thread.

7. Method according to claim 6 in which the following patterns are used:

K) $1^{st}$, $2^{nd}$ $5^{th}$ bar 0-1/1-2/2-1/1-0
$3^{rd}$, $4^{th}$, $6^{th}$ bar 2-1/1-0/0-1/1-2 with the needle guides of the first, second and sixth bars alternating one threaded with one empty; the third, fourth and fifth bars alternating one empty with one threaded;

L) $1^{st}$, $2^{nd}$ $5^{th}$ bar 0-1/1-1/1-2/2-2/2-1/1-1/1-0/0-0
$3^{rd}$, $4^{th}$ $6^{th}$ bar 1-1/1-0/0-0/0-1/1-1/1-2/2-2/2-1 with the needle guides of the first, second, third and fourth bars alternating one threaded with one empty; the fifth and sixth bars alternating one empty with one threaded;

M) $1^{st}$, $2^{nd}$ bars 1-2/1-1/1-0/1-1
$3^{rd}$, $4^{th}$ bars 1-1/1-2/1-1/1-0
$5^{th}$ bar 1-0/1-1/1-2/1-1
$6^{th}$ bar 1-1/1-0/1-1/1-2 with the needle guides of the first, second and fifth bars alternating one threaded with one empty; the third, fourth and sixth bars alternating one empty with one threaded;

N) $1^{st}$, $2^{nd}$ $5^{th}$ bars 4-5/3-2/1-0/2-3
$3^{rd}$, $4^{th}$, $6^{th}$ bars 1-0/2-3/4-5/3-2 with the needle guides of the first, second, third and fourth bars alternating one threaded with three empty; the fifth and sixth bars alternating two empty, one threaded and one empty;

O) $1^{st}$, $2^{nd}$ $5^{th}$ bar 4-5/5-4/3-2/2-3/1-0/0-1/2-3/3-2
$3^{rd}$, $4^{th}$ $6^{th}$ bar 1-0/0-1/2-3/3-2/4-5/5-4/3-2/2-3 with the needle guides of the first, second, third and fourth bars alternating one threaded with three empty; the fifth and sixth bars alternating two empty, one threaded and one empty.

8. An elastic warp knitted fabric, comprising:

a knit having four threads comprising two elastic threads and two non-elastic threads, wherein each said elastic thread is knitted in parallel with at least one of said non-elastic threads, said knit forming a pattern using a four-bar knitting structure, said pattern selected from the group consisting of:

| | | |
|---|---|---|
| a) | $1^{st}$ bar 2-3/1-0 | non-elastic thread |
| | $2^{nd}$ bar 2-3/1-0 | elastic thread |
| | $3^{rd}$ bar 1-0/2-3 | elastic thread |
| | $4^{th}$ bar 1-0/2-3 | non-elastic thread |
| b) | $1^{st}$ bar 2-3/2-1/3-4/2-1/2-3/1-0 | non-elastic thread |
| | $2^{nd}$ bar 2-3/2-1/3-4/2-1/2-3/1-0 | elastic thread |
| | $3^{rd}$ bar 2-1/2-3/1-0/2-3/2-1/3-4 | elastic thread |
| | $4^{th}$ bar 2-1/2-3/1-0/2-3/2-1/3-4 | non-elastic thread |
| c) | $1^{st}$ bar 1-0/2-1/2-3/1-2 | non-elastic thread |
| | $2^{nd}$ bar 1-0/2-1/2-3/1-2 | elastic thread |
| | $3^{rd}$ bar 2-3/1-2/1-0/2-1 | elastic thread |
| | $4^{th}$ bar 2-3/1-2/1-0/2-1 | non-elastic thread |
| d) | $1^{st}$ bar 1-0/1-2/2-3/2-1 | non-elastic thread |
| | $2^{nd}$ bar 1-0/1-2/2-3/2-1 | elastic thread |
| | $3^{rd}$ bar 2-3/1-2/1-0/1-2 | elastic thread |
| | $4^{th}$ bar 2-3/1-2/1-0/1-2 | non-elastic thread |
| e) | $1^{st}$ bar 2-3/1-0/2-3/2-1/2-3/1-0/2-3/1-0/1-2/1-0 | non-elastic thread |
| | $2^{nd}$ bar 2-3/1-0/2-3/2-1/2-3/1-0/2-3/1-0/1-2/1-0 | elastic thread |

-continued

| | | |
|---|---|---|
| 3rd bar | 1-0/2-3/1-0/1-2/1-0/2-3/1-0/2-3/2-1/2-3 | elastic thread |
| 4th bar | 1-0/2-3/1-0/1-2/1-0/2-3/1-0/2-3/2-1/2-3 | non-elastic thread |
| f) 1st bar | 1-0/2-3/2-1/2-3 | non-elastic thread |
| 2nd bar | 1-0/2-3/2-1/2-3 | elastic thread |
| 3rd bar | 2-3/1-0/1-2/1-0 | elastic thread |
| 4th bar | 2-3/1-0/1-2/1-0 | non-elastic thread |
| alone or in combination with other knitting steps | | |
| g) 1st bar | 1-0/2-3/4-5/3-2 | non-elastic thread |
| 2nd bar | 1-0/2-3/4-5/3-2 | elastic thread |
| 3rd bar | 4-5/3-2/1-0/2-3 | elastic thread |
| 4th bar | 4-5/3-2/1-0/2-3 | non-elastic thread |
| g') 1st bar | 1-0/3-2/4-5/2-3 | non-elastic thread |
| 2nd bar | 1-0/3-2/4-5/2-3 | elastic thread |
| 3rd bar | 4-5/2-3/1-0/3-2 | elastic thread |
| 4th bar | 4-5/2-3/1-0/3-2 | non-elastic thread |
| h) 1st bar | 1-2/1-0 | non-elastic thread |
| 2nd bar | 1-2/1-0 | elastic thread |
| 3rd bar | 1-0/1-2 | elastic thread |
| 4th bar | 1-0/1-2 | non-elastic thread |
| i) 1st bar | 1-2/1-1/1-0/1-1 | non-elastic thread |
| 2nd bar | 1-2/1-1/1-0/1-1 | elastic thread |
| 3rd bar | 1-1/1-0/1-0/1-2 | elastic thread |
| 4th bar | 1-1/1-0/1-0/1-2 | non-elastic thread |
| and with knit not in opposition; | | |
| j) 1st bar | 1-0/1-1/2-3/2-2 | non elastic thread |
| 2nd bar | 1-0/1-1/2-3/2-2 | elastic thread |
| 3rd bar | 2-2/1-0/1-1/2-3 | elastic thread |
| 4th bar | 2-2/1-0/1-1/2-3 | non elastic thread |
| and with knit not in opposition. | | |

9. An elastic warp knitted fabric, comprising:

a knit having four threads comprising two elastic threads and two non-elastic threads, wherein each said elastic thread is knitted in parallel with at least one of said non-elastic threads; and fifth and sixth special effect threads further incorporated in said knit.

10. The fabric as claimed in claim 9, further comprising:

a pattern formed using a six-bar knitting structure, said pattern selected from the group consisting of:

| | |
|---|---|
| k) 1st, 2nd, 5th bar | 0-1/1-2/2-1/1-0 |
| 3rd, 4th, 6th bar | 2-1/1-0/0-1/1-2 |
| l) 1st, 2nd, 5th bar | 0-1/1-1/1-2/2-2/2-1/1-1/1-0/0-0 |
| 3rd, 4th, 6th bar | 1-1/1-0/0-0/0-1/1-1/1-2/2-2/2-2 |
| m) 1st, 2nd bar | 1-2/1-1/1-0/1-1 |
| 3rd, 4th bar | 1-1/1-2/1-1/1-0 |
| 5th bar | 1-0/1-1/1-2/1-1 |
| 6th bar | 1-1/1-0/1-1/1-2 |
| n) 1st, 2nd, 5th bar | 4-5/3-2/1-0/2-3 |
| 3rd, 4th, 6th bar | 1-0/2-3/4-5/3-2 |
| o) 1st, 2nd, 5th bar | 4-5/5-4/3-2/2-3/1-0/0-1/2-3/3-2 |
| 3rd, 4th, 6th bar | 1-0/0-1/2-3/3-2/4-5/5-4/3-2/2-3. |

11. The method as claimed in claim 3, wherein: said threading step includes two needles moving on all picks.

12. The method as claimed in claim 2, wherein: a warp knitted fabric is produced.

13. The method as claimed in claim 3, wherein: a warp knitted fabric is produced.

14. A method as claimed in claim 4, wherein: a warp knitted fabric is produced.

15. A method as claimed in claim 6, wherein: a warp knitted fabric is produced.

16. A method as claimed in claim 7, wherein: a warp knitted fabric is produced.

* * * * *